US008051892B2

(12) United States Patent
Arai et al.

(10) Patent No.: US 8,051,892 B2
(45) Date of Patent: Nov. 8, 2011

(54) METHOD OF MANUFACTURING METAL-CARBON NANOCOMPOSITE MATERIAL

(75) Inventors: Keita Arai, Nagano (JP); Atsushi Kato, Nagano (JP); Masashi Suganuma, Nagano (JP)

(73) Assignee: Nissei Plastic Industrial Co., Ltd. (JP)

( * ) Notice: Subject to any disclaimer, the term of this patent is extended or adjusted under 35 U.S.C. 154(b) by 468 days.

(21) Appl. No.: 12/308,778

(22) PCT Filed: Apr. 24, 2008

(86) PCT No.: PCT/JP2008/058315

§ 371 (c)(1), (2), (4) Date: Dec. 23, 2008

(87) PCT Pub. No.: WO2008/139943

PCT Pub. Date: Nov. 20, 2008

(65) Prior Publication Data

US 2009/0288519 A1 Nov. 26, 2009

(30) Foreign Application Priority Data

Apr. 27, 2007 (JP) ..... 2007-119436

(51) Int. Cl.
*B22D 19/14* (2006.01)

(52) U.S. Cl. ..... 164/97; 164/91

(58) Field of Classification Search ..... 164/91, 164/97, 113, 123, 461, 900; 264/122, 241; 428/293.1

See application file for complete search history.

(56) References Cited

U.S. PATENT DOCUMENTS 7,311,135 B1 * 12/2007 Suganuma et al. ..... 164/97
2004/0067153 A1 * 4/2004 Koide et al. ..... 419/8
2006/0269435 A1 * 11/2006 Yamagiwa et al. ..... 419/7

FOREIGN PATENT DOCUMENTS

JP 2006044970 2/2006

OTHER PUBLICATIONS

JPO machine translation of JP 2006-044970, Feb. 16, 2006.*

* cited by examiner

*Primary Examiner* — Jessica L Ward
*Assistant Examiner* — Kevin E Yoon
(74) *Attorney, Agent, or Firm* — Adams & Wilks

(57) ABSTRACT

A method of manufacturing a metal-carbon nanocomposite material in which aluminum is used as the matrix is disclosed. The manufacturing method comprises mixing a Si-coated carbon nanomaterial (30) and a powdered Mg material (33), heating the mixture to a melting point of the Mg material or higher, and thereafter cooling the mixture to obtain an Mg-carbon nanomaterial (34). A metal-carbon nanomaterial in which Al is used as the matrix is provided by cooling the Mg-carbon nanomaterial and molten Al (40) in a mixed state.

11 Claims, 9 Drawing Sheets

Si-COATED CARBON NANOMATERIAL

CARBON NANOMATERIAL

METHOD OF MANUFACTURING METAL-CARBON NANOCOMPOSITE MATERIAL

CROSS-REFERENCE TO RELATED APPLICATION

This application is a U.S. national stage application of International Application No. PCT/JP2008/058315, filed Apr. 24, 2008, claiming a priority date of Apr. 27, 2007, and published in a non-English language.

TECHNICAL FIELD

The present invention relates to a method of manufacturing a composite metal material in which carbon nanomaterial is used as a reinforcing material and Al is used as the matrix.

BACKGROUND ART

Carbon nanomaterials, which are nanosize carbon materials, are promising reinforcing materials, and metal-carbon nanocomposite materials can be manufactured by adding Mg and Al. The dimensions of carbon nanomaterials are reduced to the nanoscale, causing the materials to aggregate easily. In view of the above, a manufacturing method in which carbon nanomaterial is uniformly dispersed in Mg or another matrix metal is disclosed in Japanese Patent Application Laid-Open Publication No. 2006-44970 (JP 2006-044970 A).

The manufacturing method disclosed in JP 2006-044970 A is different from a manufacturing method in which a carbon nanomaterial is directly added to molten Mg. In other words, Si microparticles are deposited by vacuum deposition on the surface of the carbon nanomaterial. The Si-coated carbon nanomaterial is added to the molten Mg. Si demonstrates an anchor effect and facilitates bonding between the carbon nanomaterial and Mg. The fact that an Si-coated carbon nanomaterial is superior to a carbon nanomaterial can be evaluated based on wettability. This is due to the fact that particles of the material closely adhere to each other and the bonding properties improve as wettability increases.

FIGS. 11A and 11B show an evaluation of the wettability of a carbon nanomaterial and the Si-coated nanomaterial disclosed in JP 2006-044970 A.

The wetting angle is measured as shown in FIG. 11A when angle θ1 or θ2 is small, and as shown in FIG. 11B when one of the angles is large.

In FIG. 11A, an Si-coated carbon nanomaterial 102 is bonded by fusion to a substrate 101 (e.g., SKD61) made of steel by discharge plasma sintering, a small hole is formed in the center of the substrate 101, and the surface is polished. A vacuum pump 104 is used to form a vacuum inside a vacuum chamber 103, argon gas is subsequently supplied from an argon gas supply tube 105, and a nonoxidizing atmosphere is formed inside the vacuum chamber 103. Additionally, the interior of the vacuum chamber 103 is set to the same temperature as the molten Mg (700° C.). Next, molten Mg 107 is pushed up using a cylinder 106. The molten Mg 107 spreads on the top of the Si-coated carbon nanomaterial 102 and forms a dome. The wetting angle at this time is designated as θ1.

In FIG. 11B, an ordinary carbon nanomaterial 108 is placed on the substrate 101. The configuration is otherwise the same as in FIG. 11A, and the molten Mg 107 is substantially spherical. The wetting angle at this time is designated as θ2.

FIG. 12 shows a graph that compares wettability. Molten Mg has good wettability relative to an Si-coated carbon nanomaterial at a wetting angle θ1 of 42°. Molten Mg has poor wettability in relation to a regular carbon nanomaterial at a wetting angle θ2 of 157°. Consequently, vacuum deposition of Si microparticles on a carbon nanomaterial in advance is an effective technique.

The present inventors substituted molten Mg for molten Al and performed an experiment in which an Si-coated carbon nanomaterial was wetted with molten Al. At this point, the rolling angle was 154°, as shown at the right end of the graph. There was therefore no special significance to the vacuum depositing of Si microparticles on the carbon nanomaterial in advance. In other words, it was made apparent that an Si-coated carbon nanomaterial could not merely be added to molten Al, and a solution for this situation was necessary.

DISCLOSURE OF THE INVENTION

It is therefore an object of the present invention to provide a technique in which a carbon nanomaterial can be adequately added to molten Al.

According to a first aspect of the present invention, there is provided a method for manufacturing a metal-carbon nanocomposite material, which method comprises the steps of: preparing an Si-coated carbon nanomaterial by depositing Si microparticles on a surface of a carbon nanomaterial; obtaining an Mg-carbon nanomaterial by mixing the Si-coated carbon nanomaterial with one of a powdered Mg material and a liquid Mg material, and when the powdered Mg material is mixed, cooling the mixture after the latter is held a predetermined interval of time in a state of being heated to a melting temperature of the powdered Mg material or higher; and introducing the Mg-carbon nanomaterial into molten Al and cooling a resulted mixture after a predetermined interval of time to thereby provide the metal-carbon nanocomposite material in which Al is used as a matrix.

The method is performed so that a carbon nanomaterial is coated with Si microparticles, the Si microparticles are enclosed in an Mg material, and the Mg material is enclosed in Al. The carbon nanomaterial and Si have good compatibility, as do Si and Mg. Mg and Al also have good compatibility. Therefore, the carbon nanomaterial can be securely bonded to the Al matrix.

Preferably, the method further comprising the steps of: compounding a mixture by mixing the carbon nanomaterial and the Si microparticles; and placing the mixture in a vacuum furnace and causing the Si microparticles to be vaporized under a high-temperature vacuum and deposited on the surface of the carbon nanomaterial to thereby provide the Si-coated carbon nanomaterial. In other words, the Si microparticles are vaporized in the vacuum deposition step and the mixture is agitated by the agitation effect that accompanies the vaporization. The contact between the carbon nanomaterial and the Si vapor is accelerated by the agitation. Therefore, the Si microparticles can be uniformly dispersed on the surface of the carbon nanomaterial.

The compounding step may comprise the steps of agitating in a mixing container an organic solvent, the Si microparticles and the carbon nanomaterial and drying a resultant of the agitation. By virtue of the organic solvent, it becomes possible to prevent cohesion of the carbon nanomaterials. As a result, it becomes possible to coat the Si microparticles on the carbon nanomaterials held in a dispersed state.

According to a second aspect of the present invention, there is provided a method for manufacturing a metal-carbon nanocomposite material, which method comprises the steps of:

preparing an Si-coated carbon nanomaterial by depositing Si microparticles on a surface of a carbon nanomaterial; introducing the Si-coated carbon nanomaterial into a molten Mg material and mixing them to obtain an Mg-carbon nanomaterial; and mixing a solid Al material with the Mg-carbon nanomaterial and cooling a resulted mixture after a predetermined interval of time in a state of being heated to a melting temperature of the Al material or higher to thereby provide the metal-carbon nanocomposite material in which Al is used as a matrix.

In accordance with this method, a carbon nanomaterial is thus coated with Si microparticles, the Si microparticles are enclosed in an Mg material, the Mg material is enclosed in Al, and the carbon nanomaterial can be securely bonded to the Al matrix. However, cooling is not performed in the step for obtaining an Mg-carbon nanomaterial. For this reason, loss of thermal energy can be reduced.

According to a third aspect of the present invention, there is provided a method for manufacturing a metal-carbon nanocomposite material, which method comprises the steps of: preparing an Si-coated carbon nanomaterial by causing Si microparticles to be deposited on a surface of a carbon nanomaterial; holding the Si-coated carbon nanomaterial for a predetermined interval of time in a state of being mixed with a liquid Mg material and then cooling the same to obtain an Mg-carbon nanomaterial; pulverizing the Mg-carbon nanomaterial into a powder form; mixing a powdered Al material as a matrix with the resulted powdered Mg-carbon nanomaterial; press-packing the resulted mixture into a perform; heating the preform to a melting point of the Al material or higher in a vacuum, inert gas, or non-oxidizing gas atmosphere, and holding the same in such a state for a predetermined interval of time; and cooling the heated preform to thereby obtain the metal-carbon nanocomposite material in which Al is used as a matrix.

With this method, the carbon nanomaterial is coated with Si microparticles, the Si microparticles are enclosed in an Mg material, the Mg material is enclosed in Al, and the carbon nanomaterial can be securely bonded to the Al matrix. Powdered metallurgy techniques may be used in the manufacturing method. Using powdered metallurgy makes it possible to obtain preforms whose shape is close to that of the finished product.

Preferably, the method further comprises, after the heating step, a compaction step for compacting the perform by cooling the perform to a temperature that allows heat processing of the Al material and applying pressure for a predetermined interval of time at that temperature. Strength of the composite metal material can thus be greatly enhanced because the carbon nanomaterial and the Al material are tightly bonded via the Si microparticles when the temperature is reduced to a level that allows heat processing and when compaction is executed.

Desirably, the pressure application to the resulted compact is continued in the cooling step. Strain occurs in the metal-carbon nanocomposite material due to the difference in the cooling rate during cooling. In the present invention the occurrence of strain is reduced by the application of pressure. As a result, a metal-carbon nanocomposite material having a good shape can be obtained.

BRIEF DESCRIPTION OF THE DRAWINGS

Certain preferred embodiments of the present invention will be described below, by way of example only, with reference to the accompanying drawings, in which.

BEST MODE FOR CARRYING OUT THE INVENTION

Figure 1:
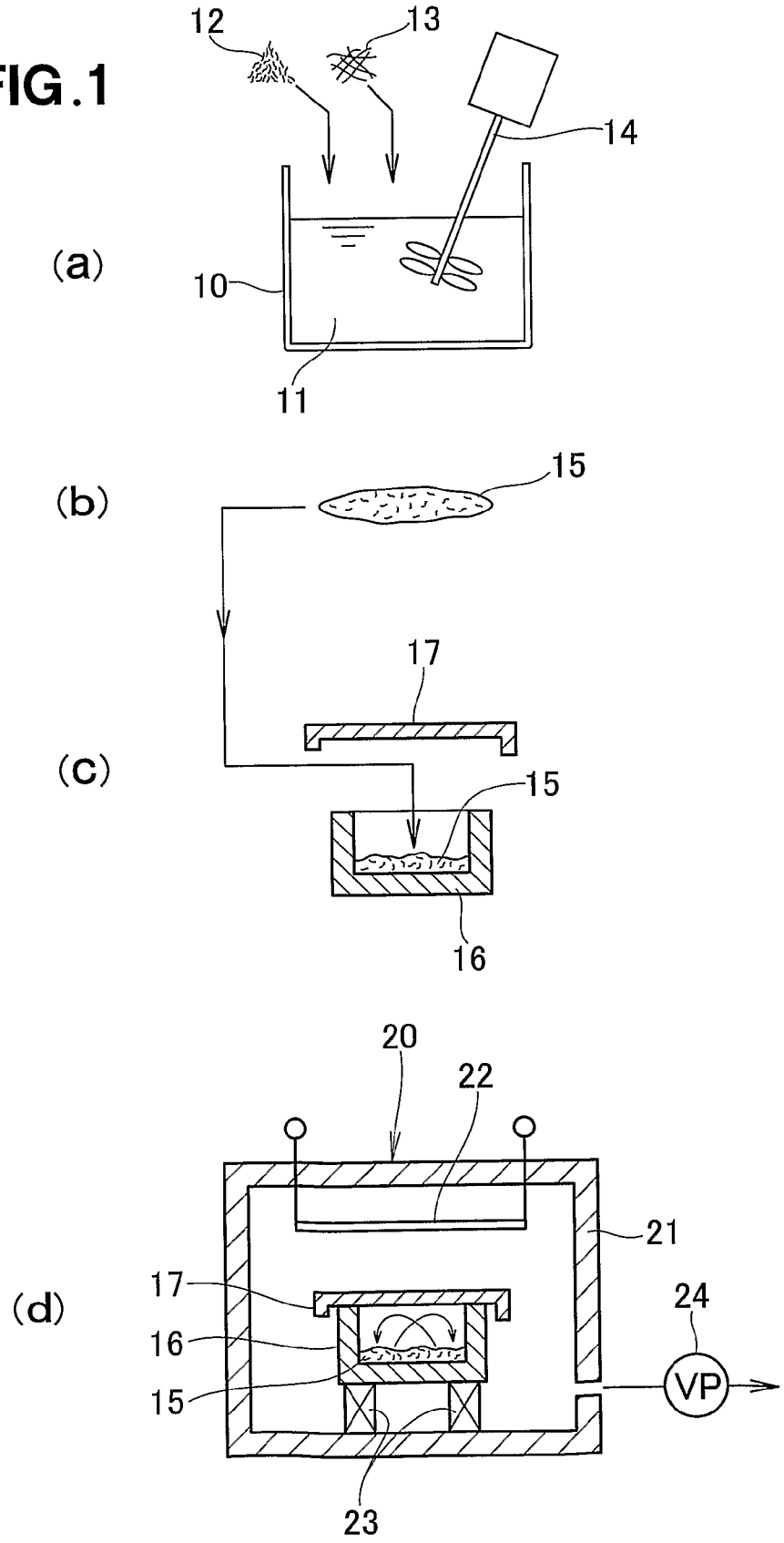
FIGS. 1(*a*)-(*d*) are schematic views illustrating a compounding step and a vacuum deposition step carried out in the present invention.

Initial reference is made to FIGS. 1(*a*) to 1(*d*) showing a compounding step and a vacuum deposition step according to the present invention.

As shown in (a) of FIG. 1, an organic solvent (e.g., 1 L of ethanol) 11 is placed into a mixing container 10. Si microparticles (e.g., 10 g) 12 and carbon nanomaterial (e.g., 10 g) 13 are added to the organic solvent 11. The system is then thoroughly agitated (e.g., 750 rpm for 2 hours) using a mixer 14. After agitation is completed, the system is suction filtrated and adequately dried (e.g., 3 hours) in hot air (e.g., 100° C.), whereby a mixture 15 shown in (b) is obtained. (a) and (b) of FIG. 1 illustrate a compounding step.

As shown in (c) of FIG. 1, the resulting mixture 15 is placed in a zirconium container 16 and is covered with a zirconium lid 17. A non-airtight lid is used as the lid 17 to allow for ventilation between the interior and the exterior of the container 16.

As shown in (d) of FIG. 1, a vacuum furnace 20 is prepared having an airtight furnace 21, heating means 22 for heating the interior of the furnace 21, a stand 23 on which the container 16 is placed, and a vacuum pump 24 for forming a vacuum inside the interior of furnace 21; and the container 16 is placed inside the vacuum furnace 20.

The interior of vacuum furnace 20 is heated in a vacuum for, e.g., 20 hours at 1200° C. The Si powder in the mixture 15 is vaporized by being heated in the vacuum. The vaporized Si makes contact with the surface of the carbon nanomaterial, forms a compound, and deposits as Si microparticles. (c) and (d) of FIG. 1 show a vacuum deposition step.

The structure of the resulting Si-coated carbon nanomaterial will be described with reference to the subsequent FIGS. 2 and 3.

Figure 2:
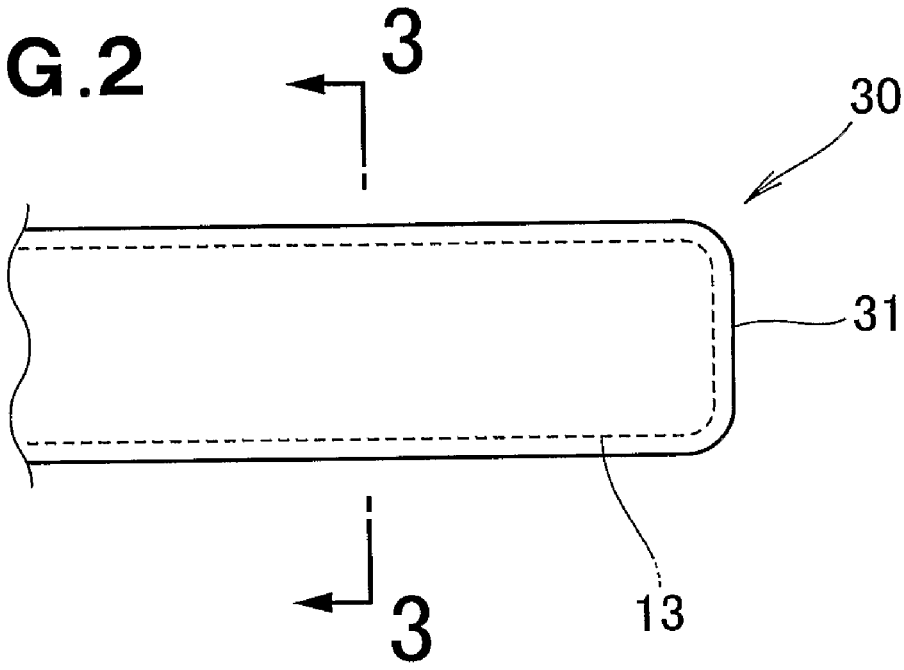
FIG. 2 is a schematic view of a Si-coated carbon nanomaterial.
Figure 3:
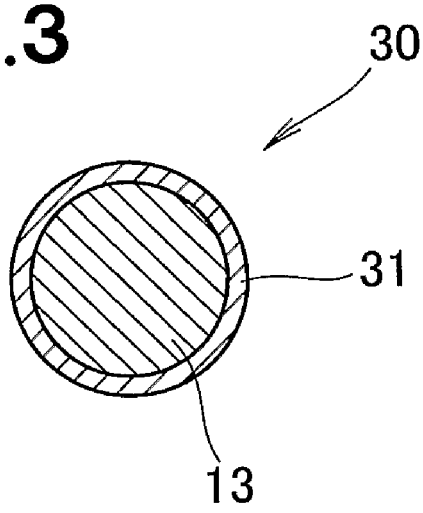
FIG. 3 is a cross-sectional view taken along line 3-3 of FIG. 2.

FIGS. 2 and 3 schematically illustrate an Si-coated carbon nanomaterial. In the Si-coated carbon nanomaterial 30, a surface of a carbon nanomaterial 13 is entirely coated with a Si microparticle layer 31.

A reaction layer composed of, e.g., SiC, is formed at the interface, and the Si microparticle layer 31 can be securely deposited on the carbon nanomaterial 13 when Si microparticles are deposited on the surface of the carbon nanomaterial 13. Therefore, there is no concern that the Si microparticle layer 31 will separate from the carbon nanomaterial 13. Furthermore, the Si microparticle layer 31 has exceptionally good wettability relative to matrix metals in comparison with the carbon nanomaterial 13.

Following is a description as to several embodiments of a method for producing a metal-carbon nanocomposite material in which the Si-coated carbon nanomaterial 30 shown in FIG. 3 is used as a starting material.

Figure 4:
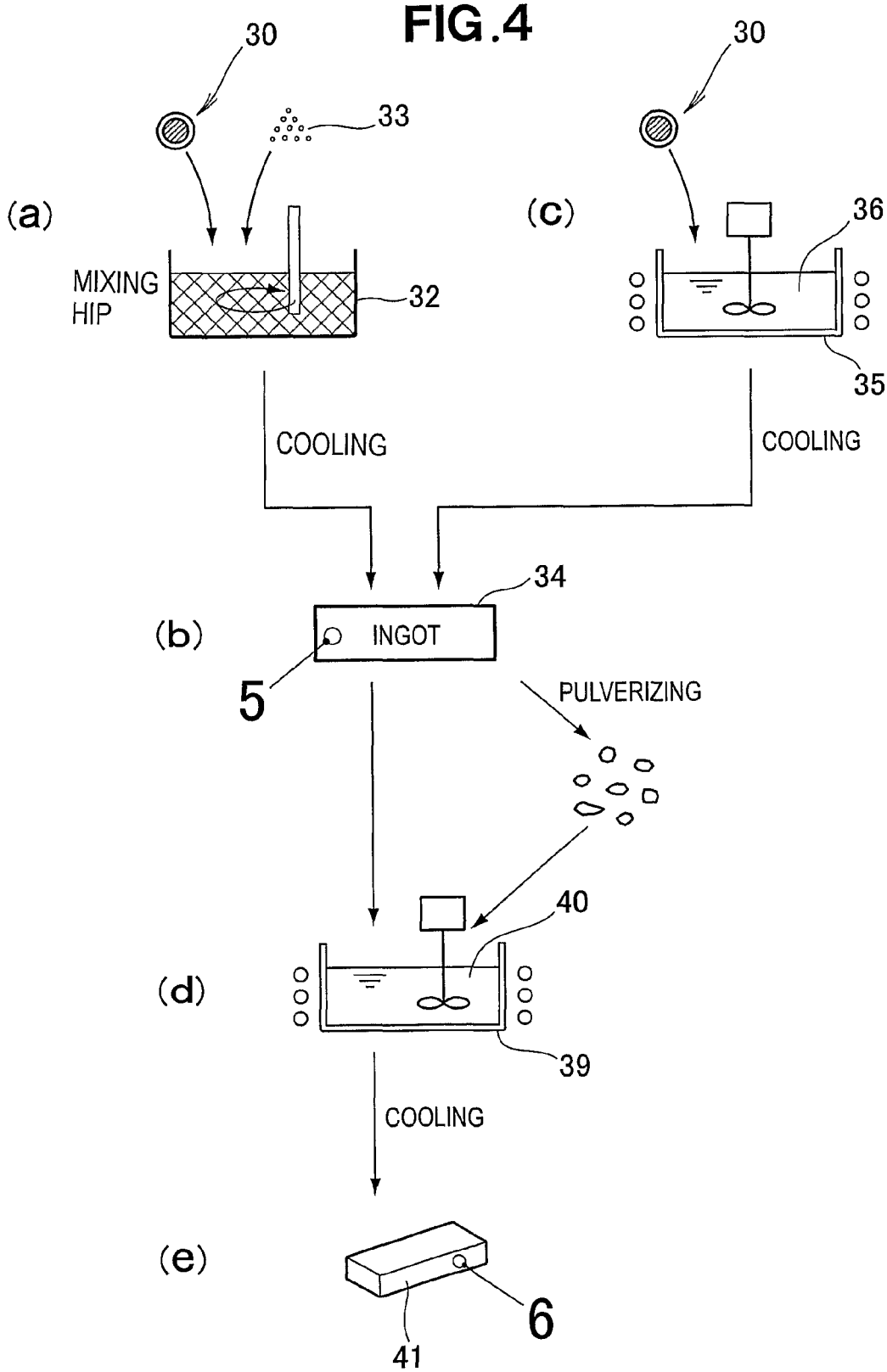
FIGS. 4(*a*)-(*e*) are schematic views illustrating a method for manufacturing a metal-carbon nanocomposite material, according to a first embodiment of the present invention.

FIGS. 4(*a*) through 4(*e*) show a method of manufacturing a metal-carbon nanocomposite material according to a first embodiment of the present invention.

The Si-coated carbon nanomaterial 30 that has Si microparticles deposited on the surface of a carbon nanomaterial is prepared in the manner shown in (a) of FIG. 4. The Si-coated carbon nanomaterial 30 and a powdered Mg material 33 are then introduced in a mixing container 32 and are thoroughly mixed. The mixture is then cooled after having been held for a predetermined interval of time at the melting temperature (about 650° C.) or higher using Hot Pressing (HP) or Hot Isostatic Pressing (HIP), yielding an ingot 34 composed of an Mg-carbon nanomaterial in the manner shown in (b) of FIG. 4.

Alternatively, a hot container 35 is filled with a molten metal 36 composed of an Mg material, and a Si-coated carbon nanomaterial 30 is placed in the molten metal 36 and is thoroughly mixed. The mixture is then cooled after being held for a predetermined interval of time, yielding an ingot 34 composed of an Mg-carbon nanomaterial in the manner shown in FIG. 4(*b*).

Figure 5:
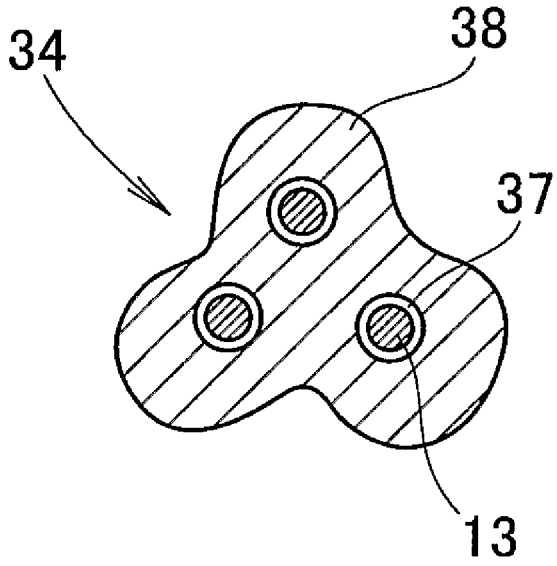
FIG. 5 is an enlarged view showing part 5 of FIG. 4(*b*)

The ingot 34 is structured so that the carbon nanomaterial 13 is enclosed in Si 37 and that Si 37 is enclosed in the Mg material 38 in the manner shown in FIG. 5.

Returning to FIG. 4, a hot container 39 is filled with a molten metal 40 composed of an Al material, and the ingot 34 is added to the molten metal 40 either directly as a unit or after being broken into pieces, as shown in FIG. 4(*d*). The mixture is then mixed and cooled after a predetermined interval of time, yielding a metal-carbon nanocomposite material 41 in which Al is the matrix, as shown in (e) of FIG. 4.

Figure 6:
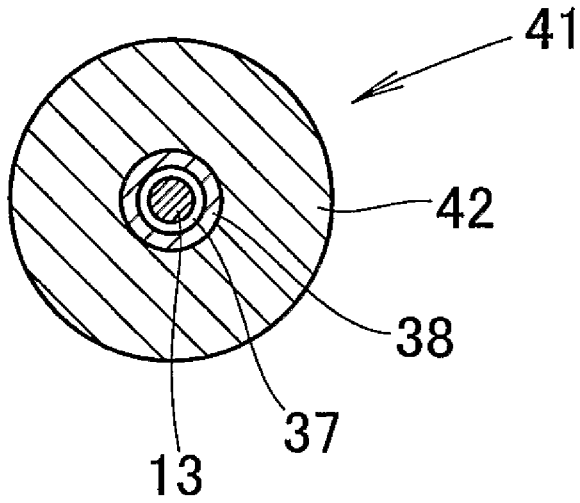
FIG. 6 is an enlarged view showing part 6 of FIG. 4(*e*)

The metal-carbon nanocomposite material 41 is structured so that the carbon nanomaterial 13 is enclosed in the Si 37, the Si 37 is enclosed in the Mg material 38, and the Mg material 38 is enclosed in the Al material 42 in the manner shown in FIG. 6.

A carbon nanomaterial and Si have good compatibility, and Si and Mg have good compatibility. Mg and Al have good compatibility. Therefore, the carbon nanomaterial 13 can be securely bonded to the Al matrix material 42.

Figure 7:
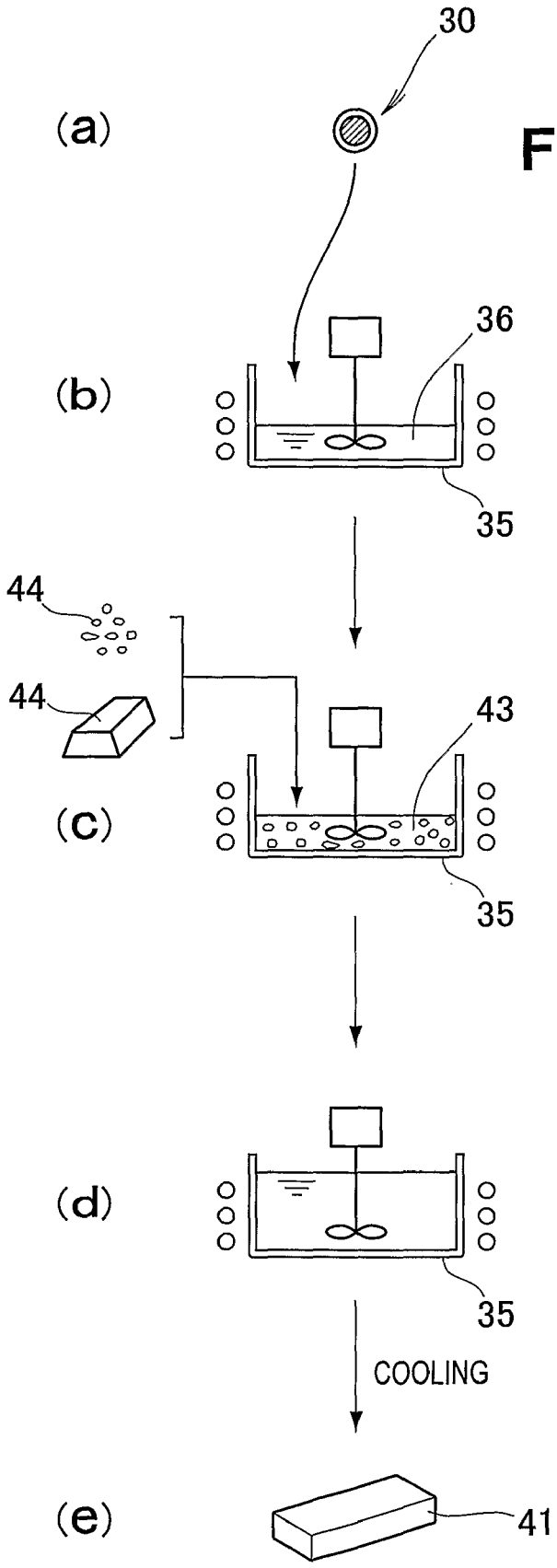
FIGS. 7(*a*)-(*e*) are schematic views illustrating the method for manufacturing a metal-carbon nanocomposite material, according to the second embodiment of the present invention.

(a) through (e) of FIG. 7 show the method of manufacturing a metal-carbon nanocomposite material according to a second embodiment.

The Si-coated carbon nanomaterial 30 that has Si microparticles deposited on the surface of a carbon nanomaterial is prepared in the manner shown in (a) of FIG. 7. A hot container 35 is then filled with a molten metal 36 composed of Mg material, and Si-coated carbon nanomaterial 30 is placed in the molten metal 36 and thoroughly mixed in the manner shown in (b) of FIG. 7. A molten metal composed of a Mg-carbon nanomaterial can thereby be obtained.

A solid Al material 44 (powder or lump) is added to a molten metal 43 composed of the Mg-carbon nanomaterial in the manner shown in (c) of FIG. 7. The temperature of the hot container 35 is increased to the melting point of the Al material (about 660° C.) or higher and the contents of the container are agitated in the manner shown in (d) of FIG. 7. The mixture is subsequently cooled after a predetermined interval of time, yielding a metal-carbon nanocomposite material 41 in which Al is the matrix, as shown in (e) of FIG. 7. The composition of the metal-carbon nanocomposite material 41 is as shown in FIG. 6.

In the manufacturing method according to the second embodiment shown in FIG. 7(*a*)-(*e*), there is no need to cool the Mg-carbon nanomaterial 43 in the step for obtaining an Mg-carbon nanomaterial shown in (b) of FIG. 7. For this reason, thermal energy loss can be reduced.

Figure 8:
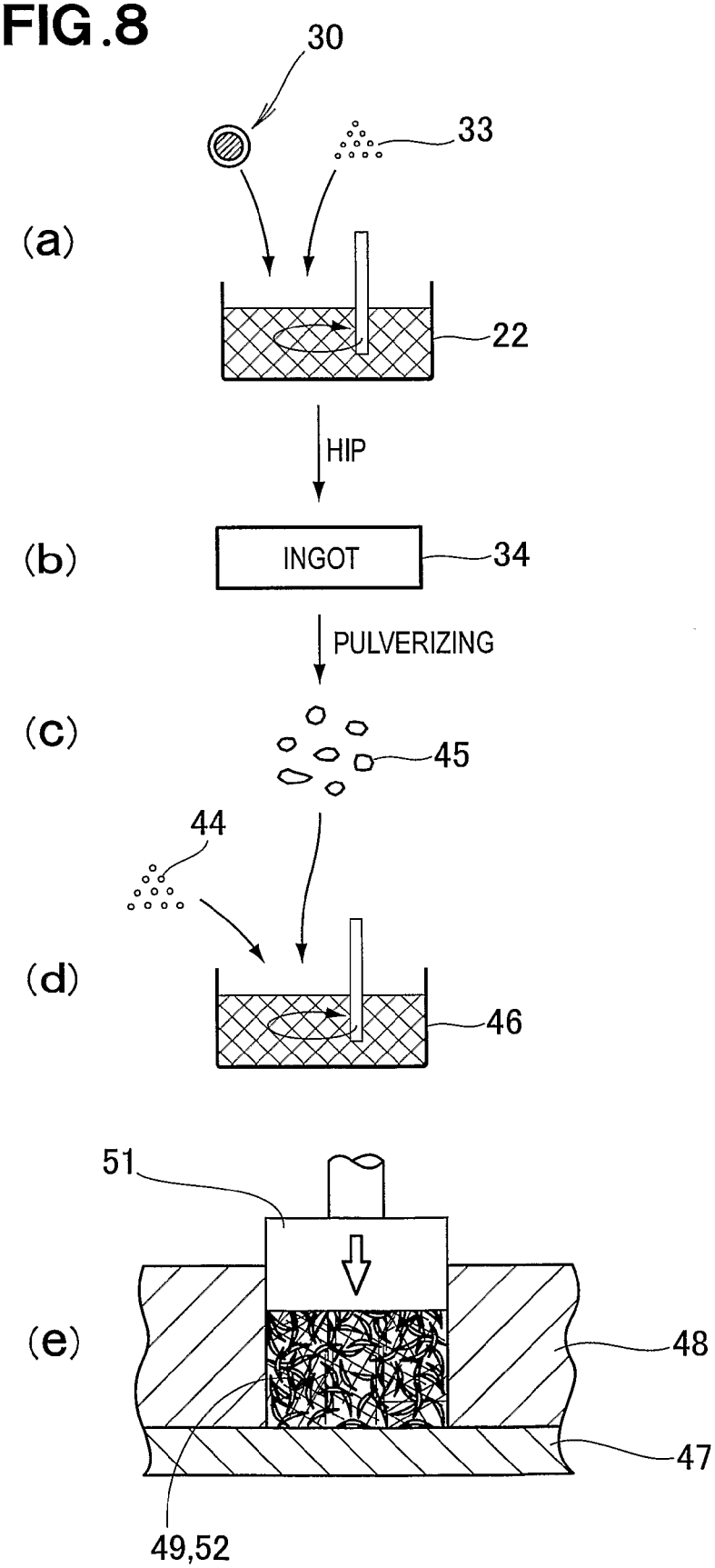
FIGS. 8(*a*)-(*e*) are schematic views illustrating a preparation step and a preforming step in a manufacturing method according to a third embodiment of the present invention.

FIG. 8 shows the steps from the preparation step to the preforming step in the manufacturing method according to a third embodiment.

The Si-coated carbon nanomaterial 30 that has Si microparticles deposited on the surface of a carbon nanomaterial is prepared in the manner shown in FIG. 8(*a*). The Si-coated carbon nanomaterial 30 and a powdered Mg material 33 are placed in a mixing container 22 and thoroughly mixed. The mixture is then cooled after having been held for a predetermined interval of time at the melting temperature or higher using HP or HIP, yielding an ingot 34 composed of the Mg-carbon nanomaterial shown in FIG. 8(*b*).

The ingot 34 is pulverized, yielding a powder 45 composed of the Mg-carbon nanomaterial in FIG. 8(*c*).

The powder 45 composed of the Mg-carbon nanomaterial, and a powdered solid Al material 44 are placed in a mixing container 46 and are thoroughly mixed in the manner shown in FIG. 8(*d*).

A die 48 is placed on a base 47 in FIG. 8(*e*). The mixture 49 obtained in (d) is filled into the die 48. A punch 51 is subsequently inserted into the die, and the mixture 49 is pressed and packed. The pressed and packed substance forms a preform 52.

A processing unit 60 is prepared as shown in the next drawing in order to execute the heating step, the compaction step, and the cooling step of the present invention.

Figure 9:
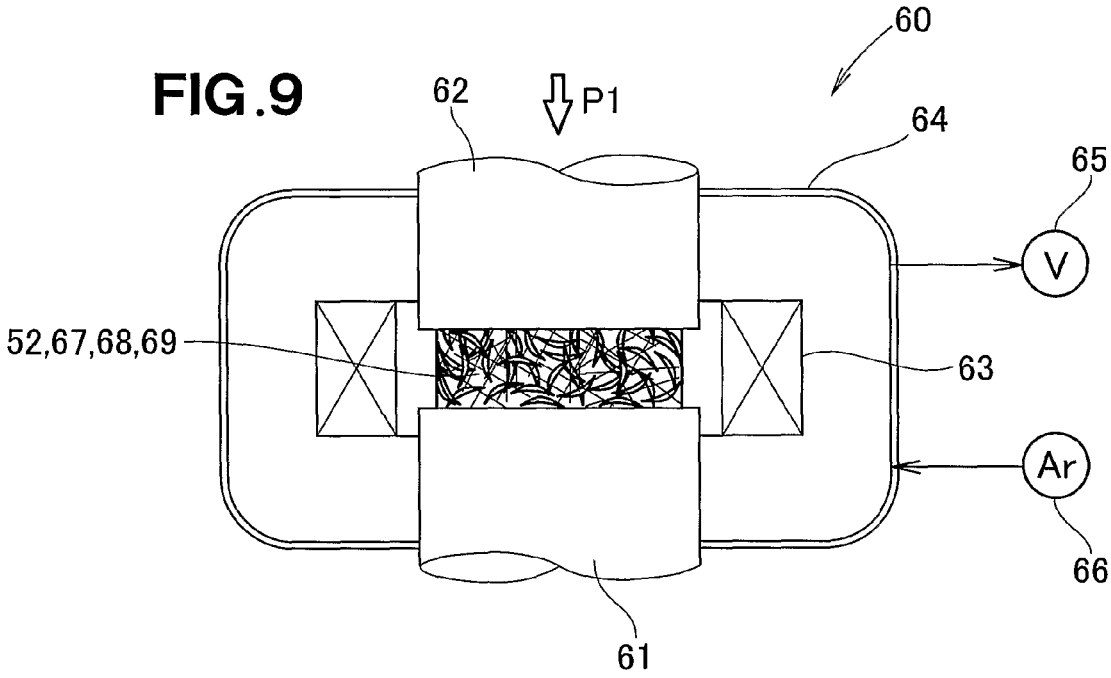
FIG. 9 is a schematic view showing a heating step to a cooling step in the manufacturing method according to the third embodiment of the present invention.

FIG. 9 shows the heating step to the cooling step in the manufacturing method according to the third embodiment of the present invention.

The processing unit 60 is composed of a lower punch 61 for supporting the preform 52; an upper punch 62 arranged opposite to the lower punch 61 and capable of pressing or compacting (applying pressure to) the preform 52 by using a pressure P1; a heater 63 that encloses the preform 52; a chamber 64 that encloses the heater 63, the preform 52, and the like as unit; a vacuum exhaust device 65 that is connected to the chamber 64 and forms a vacuum in the chamber 64; and an inert gas blower 66 for blowing argon as an inert gas into the chamber 64. The processing unit 60 is controlled in accordance with a control curve shown in the next drawing.

Figure 10:
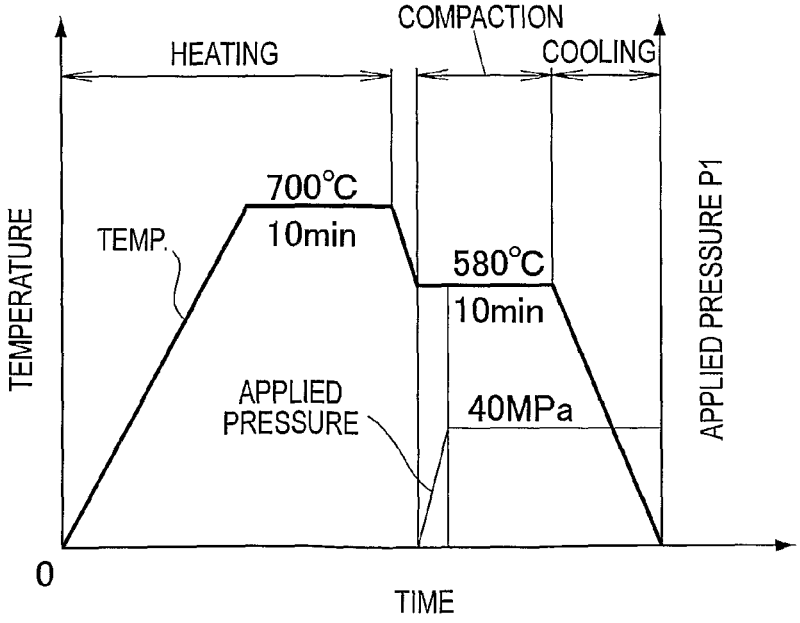
FIG. 10 is a graph showing the heating step, a compaction step and the cooling step of FIG. 9.
Figure 11A:
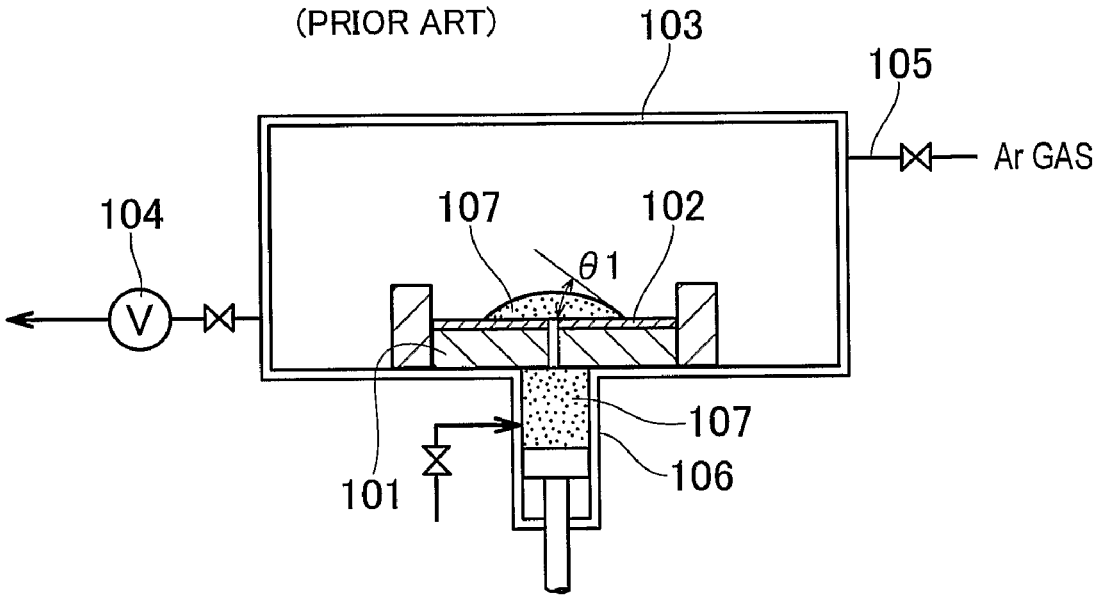
FIG.11A (PRIOR ART)
FIGS. 11A and 11B are schematic views showing the wettability evaluation of a conventional metal-carbon nanocomposite material.
Figure 11B:
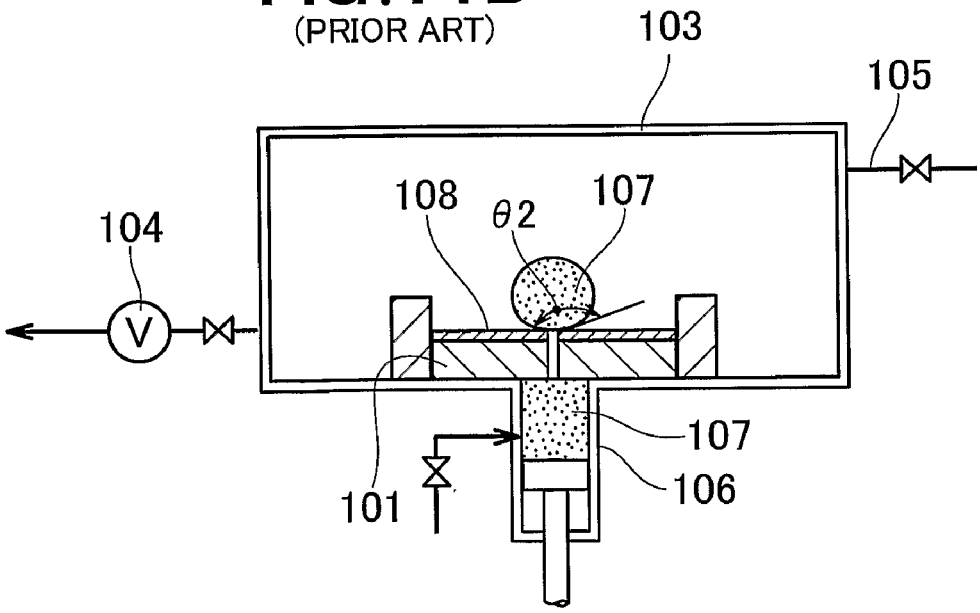
FIG.11B (PRIOR ART)
Figure 12:
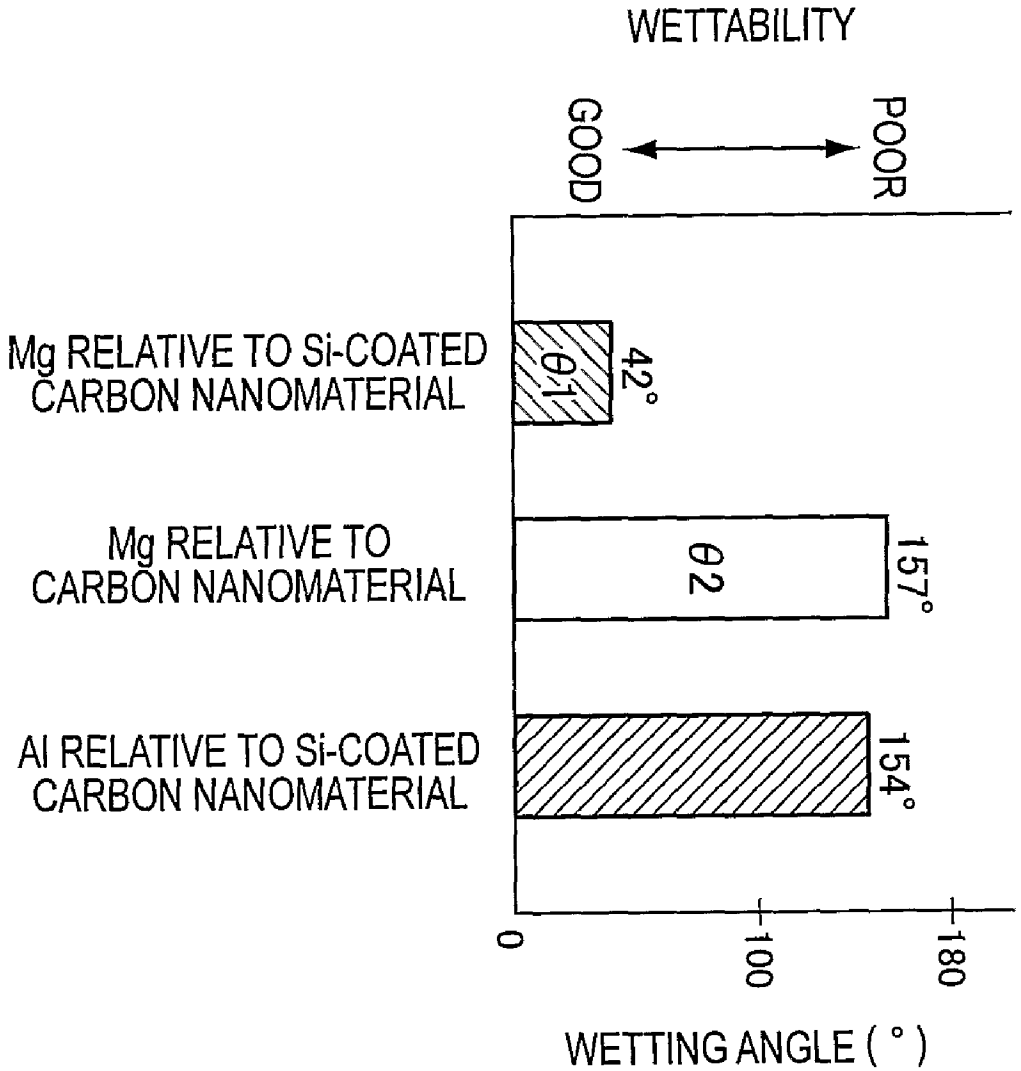
FIG.12 (PRIOR ART)
FIG. 12 is a graph showing a comparison of wettability of conventional metal-carbon nanocomposite materials.

FIG. 10 shows a graph of the heating step, the compaction step, and the cooling step being performed by the processing unit 60 shown in FIG. 9. In the graph, a temperature curve and a pressure curve are shown on the graph in which the horizontal axis represents time, the left vertical axis represents temperature, the right vertical axis represents pressure P1, and the heating step, the compaction step, and the cooling step are shown in the upper part of the graph.

In the heating step, a vacuum is formed in the chamber, and the vacuum is left unchanged, or an inert gas such as argon or a non-oxidative gas such as nitrogen is subsequently sealed in. The preform is then heated to 700° C. at a prescribed heating (temperature increase) rate and is held for 10 minutes after 700° C. has been reached, yielding a heat-treated substance 67 (FIG. 9).

The matrix metal material melts when heated to 700° C. and permeates the microparticle-coated carbon nanomaterial because the melting point of Mg is 650° C. Sufficient permeation can be achieved with a holding time of 10 minutes.

The temperature setting of the heater 63 shown in FIG. 9 is reduced, whereby the heat-treated substance 67 is cooled to a temperature that allows the matrix metal material to be heat processed. Since the melting point of Mg is 650° C., reducing the temperature by about 70° C. to a low temperature of 580° C. allows the surface layer to solidify adequately and eliminates any concern that the liquid phase will leak when compressed.

The upper punch 62 is lowered and a pressure of 40 MPa is applied to the heat-treated substance 67 when 580° C. is reached. The temperature is held for 10 minutes at 580° C. while pressure is applied. The upper punch 62 is lowered in small increments during this holding period. The descent is continued for 5 to 7 minutes and is stopped thereafter. Small voids appear in the structure while the upper punch 62 is descending, and the presence of such voids indicates compaction. It can be concluded that sufficient density is reached once the descending movement of the upper punch 62 stops. The resulting compact 68 (FIG. 9) is thoroughly compacted.

The compaction can be performed at any temperature that allows the matrix metal material to be heat processed. However, the required pressure for compaction is dependent on the temperature, and the processing is preferably carried out in a maximum possible temperature range because, as the temperature is increased, compaction can be performed at a lower pressure and can easily be carried out even using relatively low-strength carbon molds and the like.

Processibility decreases and, particularly, compaction becomes difficult because cracks, fissures, and the like readily occur in the Mg or Mg alloy of the matrix metal material, at a temperature below the temperature at which heat processing can be carried out.

A liquid phase state is reached, the liquid phase leaks due to the application of pressure, the force of applied pressure no longer functions well, and compaction becomes difficult at a high temperature above the temperature at which heat processing can be carried out.

The metal-carbon nanocomposite material 69 (FIG. 9) can be obtained by cooling the resulting compact 68 to room temperature while the compact is held down by the upper punch 62. The strain referred to as cooling strain can occur due to the temperature difference because the surface temperature of the compact 68 is reduced first, and the temperature at the center is reduced with a delay. The cooling strain can be reduced by continuing to hold the substance down using the upper punch 62. However, cooling without the application of pressure (without holding down the compact 68 by using the upper punch 62) is possible when there is no concern for cooling strain.

INDUSTRIAL APPLICABILITY

The present invention is useful in a method of manufacturing a composite metal material in which a carbon nanomaterial is used as the reinforcing material and aluminum is used as the matrix.

The invention claimed is:

1. A method for manufacturing a metal-carbon nanocomposite material, comprising the steps of:

preparing an Si-coated carbon nanomaterial by depositing Si microparticles on a surface of a carbon nanomaterial;

producing an Mg coating on the Si-coated carbon nanomaterial by mixing the Si-coated carbon nanomaterial with one of a powdered Mg material and a liquid Mg material, and when the powdered Mg material is mixed, cooling the mixture after the latter is held a predetermined interval of time in a state of being heated to a melting temperature of the powdered Mg material or higher; and introducing the Mg- and Si-coated nanomaterial into molten Al and cooling a resulted mixture after a predetermined interval of time to thereby obtain a metal-carbon nanocomposite material in which Al is used as a matrix.

2. The method of claim 1, further comprising the steps of:

compounding a mixture by mixing the carbon nanomaterial and the Si microparticles; and placing the mixture in a vacuum furnace and causing the Si microparticles to be vaporized under a high-temperature vacuum and deposited on the surface of the carbon nanomaterial to thereby provide the Si-coated carbon nanomaterial.

3. The method of claim 2, wherein the compounding step comprises the steps of agitating in a mixing container an organic solvent, the Si microparticles and the carbon nanomaterial and then drying a resultant of the agitation.

4. A method for manufacturing a metal-carbon nanocomposite material, comprising the steps of:

preparing an Si-coated carbon nanomaterial by depositing Si microparticles on a surface of a carbon nanomaterial;

introducing the Si-coated carbon nanomaterial into a molten Mg material and mixing them to produce an Mg coating on the Si-coated carbon nanomaterial; and mixing a solid Al material with the Mg- and Si-coated nanomaterial and cooling a resulted mixture after a predetermined interval of time in a state of being heated to a melting temperature of the Al material or higher to thereby obtain the metal-carbon nanocomposite material in which Al is used as a matrix.

5. The method of claim 4, further comprising the steps of:

compounding a mixture by mixing the carbon nanomaterial and the Si microparticles;

placing the resulted mixture in a vacuum furnace and causing the Si microparticles to be vaporized under a high-temperature vacuum and deposited on the surface of the carbon nanomaterial to thereby provide the Si-coated carbon nanomaterial.

6. The method of claim 5, wherein the compounding step comprises the steps of agitating in a mixing container an organic solvent, the Si microparticles and the carbon nanomaterial and then drying a resultant of the agitation.

7. A method for manufacturing a metal-carbon nanocomposite material, comprising the steps of:

preparing an Si-coated carbon nanomaterial by causing Si microparticles to be deposited on a surface of a carbon nanomaterial;

holding the Si-coated carbon nanomaterial for a predetermined interval of time in a state of being mixed with a liquid Mg material and then cooling the same to produce an Mg coating on the Si-coated carbon nanomaterial;

pulverizing the Mg- and Si-coated nanomaterial into a powder form;

mixing a powdered Al material as a matrix with the resulted powdered Mg- and Si-coated nanomaterial;

press-packing the resulted mixture into a preform;

heating the preform to a melting point of the Al material or higher in a vacuum, inert gas, or non-oxidizing gas atmosphere, and holding the same in such a state for a predetermined interval of time; and cooling the heated preform to thereby obtain the metal-carbon nanocomposite material in which Al is used as a matrix.

8. The method of claim 7, further comprising, after the heating step, a compaction step for compacting the perform by cooling the preform to a temperature that allows heat processing of the Al material and applying pressure for a predetermined interval of time at that temperature.

9. The method of claim 8, wherein the pressure application to the resulted compact is continued in the cooling step.

10. The method of claim 7, further comprising the steps of:

compounding a mixture by mixing the carbon nanomaterial and the Si microparticles; and placing the mixture in a vacuum furnace and causing the Si microparticles to be vaporized under a high-temperature vacuum and deposited on the surface of the carbon nanomaterial to thereby provide the Si-coated carbon nanomaterial.

11. The method of claim 10, wherein the compounding step comprises the steps of agitating in a mixing container an organic solvent, the Si microparticles and the carbon nanomaterial and then drying a resultant of the agitation.

* * * * *